US006343839B1

(12) United States Patent
Simons, Jr. et al.

(10) Patent No.: US 6,343,839 B1
(45) Date of Patent: Feb. 5, 2002

(54) FLEXIBLE ARMREST CONSTRUCTION

(75) Inventors: George J. Simons, Jr., Grand Rapids, MI (US); Thomas Overthun, San Francisco, CA (US); Alan M. Vale, Sunnydale, CA (US); Thomas B. Eich; Jonathan I. Kaplan, both of Palo Alto, CA (US)

(73) Assignees: Steelcase Development Corporation, Caledonia, MI (US); TechnoGel GmbH & Co. KG, Duderstadt (DE)

( * ) Notice: Subject to any disclaimer, the term of this patent is extended or adjusted under 35 U.S.C. 154(b) by 0 days.

(21) Appl. No.: 09/466,445

(22) Filed: Dec. 17, 1999

(51) Int. Cl.[7] ..... A47C 7/54
(52) U.S. Cl. ..... 297/411.2; 297/411.37
(58) Field of Search ..... 297/411.2, 411.37, 297/411.35, 452.41, 463.2, 184.12, 188.19, 227, 184.14; 5/654, 655.5, 909, 644, 645, 646

(56) References Cited

U.S. PATENT DOCUMENTS

| | | | | |
|---|---|---|---|---|
| 2,291,377 | A | * | 7/1942 | Clark |
| 2,346,629 | A | | 4/1944 | Travers |
| 2,418,092 | A | * | 3/1947 | Passel |
| 3,362,749 | A | | 1/1968 | Clement |
| 3,387,881 | A | | 6/1968 | Stepanek et al. |
| 3,400,979 | A | | 9/1968 | James |
| 3,884,523 | A | * | 5/1975 | Allen |
| 4,226,464 | A | | 10/1980 | Janz et al. |
| 4,331,360 | A | | 5/1982 | Roudybush et al. |
| 4,456,644 | A | | 6/1984 | Janz et al. |
| 4,815,361 | A | | 3/1989 | Chiarella |
| 4,869,543 | A | | 9/1989 | Grimes |
| 4,951,995 | A | | 8/1990 | Teppo et al. |
| 5,048,892 | A | * | 9/1991 | Ledbetter |
| D349,621 | S | | 8/1994 | Wilson |
| 5,334,646 | A | | 8/1994 | Chen |
| 5,382,079 | A | | 1/1995 | Wilson et al. |
| 5,385,388 | A | | 1/1995 | Faiks et al. |
| D360,316 | S | | 7/1995 | Hodge et al. |
| 5,439,267 | A | | 8/1995 | Peterson et al. |
| 5,441,676 | A | | 8/1995 | Bigolin |
| 5,445,430 | A | | 8/1995 | Nichols |
| D362,973 | S | | 10/1995 | Schultz |
| D363,383 | S | | 10/1995 | Cronk |
| D367,980 | S | | 3/1996 | Hodge et al. |
| 5,508,334 | A | | 4/1996 | Chen |
| 5,566,778 | A | | 10/1996 | Valier et al. |
| D375,863 | S | | 11/1996 | Bigolin |
| D376,716 | S | | 12/1996 | Nemeth, Jr. |
| 5,599,067 | A | | 2/1997 | Schuelke et al. |
| 5,626,382 | A | | 5/1997 | Johnson et al. |
| 5,633,286 | A | | 5/1997 | Chen |
| 5,647,638 | A | | 7/1997 | Ritt et al. |
| D383,932 | S | | 9/1997 | Nemeth, Jr. |
| 5,670,232 | A | | 9/1997 | Bigolin |

(List continued on next page.)

*Primary Examiner*—Milton Nelson, Jr.
(74) *Attorney, Agent, or Firm*—Price Heneveld Cooper DeWitt & Litton

(57) ABSTRACT

A component has a support with a stiff section and a flexible section. An incompressible resilient material, such as a gel, is supported on the flexible section. In one form, the component forms an armrest, with the support including upper and lower sections forming a loop. The upper section bridges between ends of the lower section and includes the flexible section, and a section of gel material is positioned on or molded onto the flexible section. In the armrest, the incompressible resilient material is sufficiently thick and resilient to comfortably support a person's forearm on the support yet further is sufficiently flowable and stretchable to at least partially move off a rib on the support and into the non-supporting areas when pressure is applied to the incompressible resilient material.

22 Claims, 5 Drawing Sheets

U.S. PATENT DOCUMENTS

| | | | | |
|---|---|---|---|---|
| D390,712 | S | | 2/1998 | Koepke et al. |
| 5,803,415 | A | | 9/1998 | Konishi et al. |
| 5,853,223 | A | | 12/1998 | Ritt et al. |
| 5,871,258 | A | | 2/1999 | Battey et al. |
| D409,863 | S | | 5/1999 | Chu |
| 5,904,396 | A | * | 5/1999 | Yates |
| 5,932,046 | A | | 8/1999 | Yates |
| 6,033,013 | A | | 3/2000 | Lee |
| 6,082,683 | A | * | 7/2000 | Yates |

* cited by examiner 32
33
36
46
47
59
60
61
62
63
64
65
66
67
68
69
70
71
72
82

FLEXIBLE ARMREST CONSTRUCTION

BACKGROUND OF THE INVENTION

The present invention relates to flexible supports adapted with a section configured to evenly and comfortably support an object or body part placed on the support, and more particularly relates to a support including a flexible area and a gel-like or flowable material coupled to the flexible area.

Distribution of stress and the related aspect of comfort is an important quality in many products, especially furniture products such as seating. Traditionally, such furniture has included foam cushions to provide resilient support to users. However, foam cushions suffer from several limitations. Foam cushions compress and collapse in ways that do not necessarily optimally distribute stress, nor do they optimally provide the best support to a user. For example, in cushioned armrests, it is not uncommon for one area to fully compress, while another area does not. One reason may be because the area being compressed is limited by a perpendicular thickness of the foam cushion. For example, this can occur where the foam is formed into a thin sheet in order to avoid a "stuffed chair" look. Thus, areas of the cushion may compress to a point where they bottom-out, such that they cause high-pressure areas. Also, traditional cushions cannot flow laterally and "re-distribute" themselves to more uniformly support a weight rested thereon.

Foam cushions also have other problems Not only do they wear out, but their compression properties change over time. Also they may break down and disintegrate in a manner resulting in dust and fine debris. Further, many cushions are made from strong chemicals that are toxic or dangerous, such that they are potential environmental pollutants.

Aside from the above, it is desirable to provide adjustable furniture with an indicator providing a status of the adjustment. For example, this can be useful so that a user is able to quickly adjust a component to a known position of comfort. Further, many consumers want to see the "high tech" looking components that provide the adjustment.

Accordingly, an apparatus solving the aforementioned problems and having the aforementioned advantages is desired.

SUMMARY OF THE PRESENT INVENTION

In one aspect of the present invention, an armrest includes an armrest-supporting structure adapted for connection to a chair base. An armrest support includes at least one stiff section and a flexible section connected to the stiff section. The stiff section is located in a perimeter area of the armrest support and includes a mount secured to the armrest-supporting structure. A section of incompressible resilient material is coupled to and supported by the flexible section.

In another aspect of the present invention, an apparatus includes a support component having a stiff section with an attachment mount thereon and a flexible section extending from the stiff section. The flexible section includes strips of material constructed to flex relative to the stiff section. Incompressible resilient material is coupled to the flexible section for cooperative distribution of stress.

In another aspect of the present invention, a furniture component includes a support component having an apertured region with openings formed therein, and gel material positioned on the apertured region. The gel material has a memory but is configured to stretch and flow into the openings when pressure is applied to the gel material, such that the gel material distributes stress and provides a more uniform supporting action when an item is supported on the gel material and the support.

In another aspect of the present invention, an apparatus includes a support defining an elongated rib and non-supporting areas on opposing sides of the rib, the non-supporting areas being one of apertures or depressed areas. An incompressible resilient material is positioned on the support over the rib and the non-supporting areas. The incompressible resilient material is sufficiently thick and stiff to comfortably support a person's forearm on support and the rib, yet further is sufficiently flowable and stretchable to allow at least some of the incompressible resilient material to move off the rib and into the non-supporting areas when pressure is applied to the incompressible resilient material.

In another aspect of the present invention, a furniture component includes a support for supporting a human body part, the support defining first and second sections that are interconnected. Flowable material is coupled to the support and configured to flow from the first section toward the second section to more uniformly distribute stress when a human body part is placed on the support.

In another aspect, an apparatus includes an article, a component attached to the article, the component being shaped and configured to support a human body part, and a transparent material covering at least one side of the component. The clear material prevents physical access to the component but allows visual access to the component.

In another aspect, an apparatus includes an article, a structural component attached to the article, and an incompressible resilient material covering a portion of the structural component. The incompressible flexible material provides an outer surface shaped to be comfortably grasped and further provides a section capable of flowing and flexure to evenly distribute stress when the outer surface is grasped.

These and other aspects, advantages, and objects will be further understood and appreciated by those skilled in the art upon a close reading of the present specification, claims and appended drawings.

DETAILED DESCRIPTION OF PREFERRED EMBODIMENT

Figure 1:
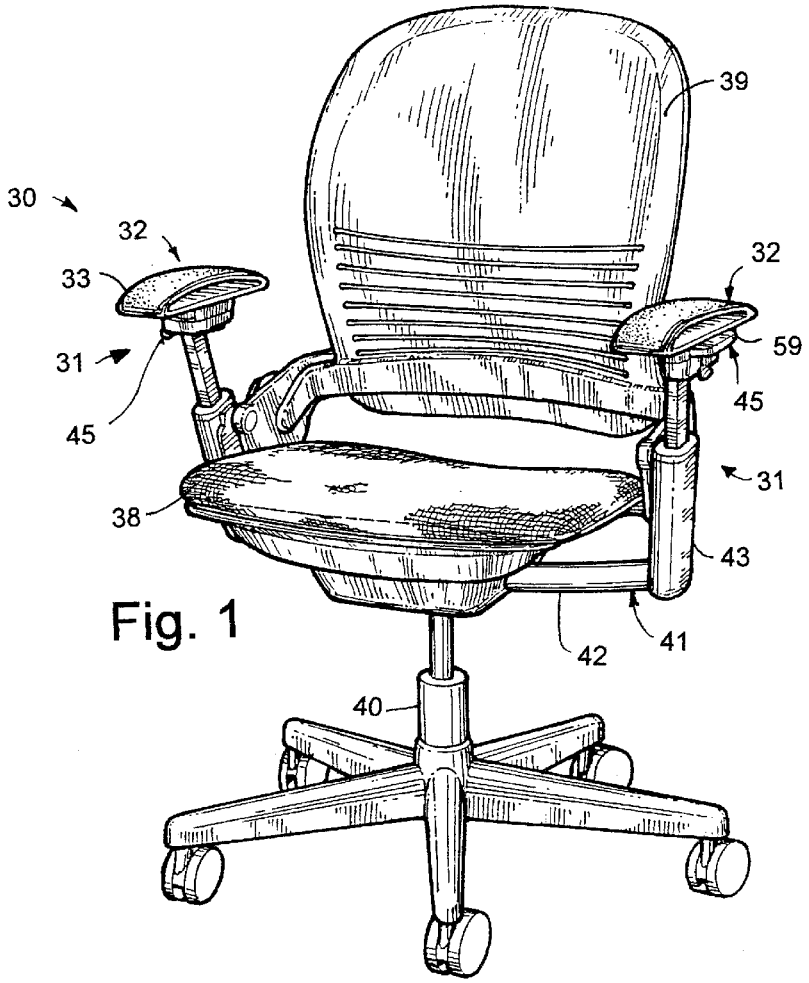
FIG. 1 is a perspective view of a chair with armrests embodying the present invention.
Figure 16:
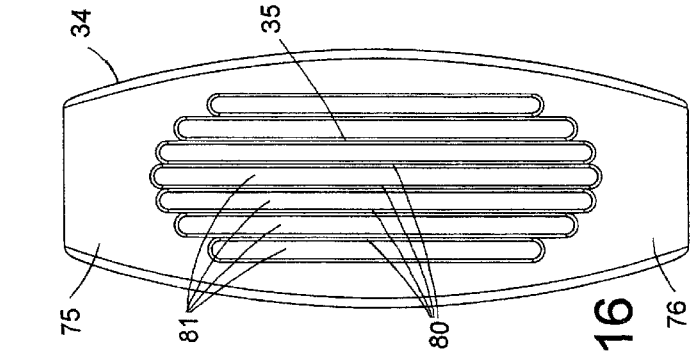
FIGS. 15–18 are front, top, side, and bottom views of the internal support of the armrest shown in FIG. 10, including the perimeter-positioned stiff section and the interiorly-positioned flexible section.
Figure 14:
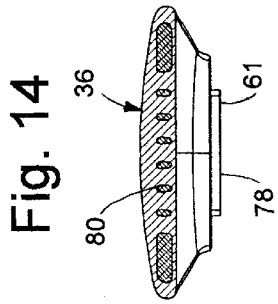
FIGS. 13–14 are cross-section views taken along lines XIII—XIII and XIV—XIV in FIG. 10.
Figure 15:
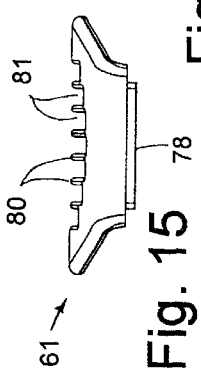
Figure 13:
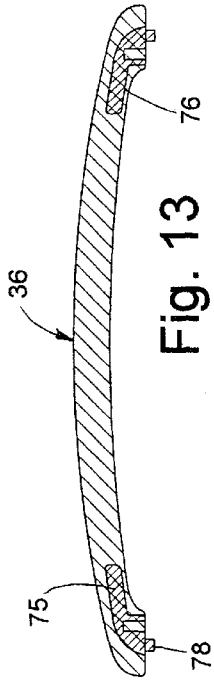
Figure 10:
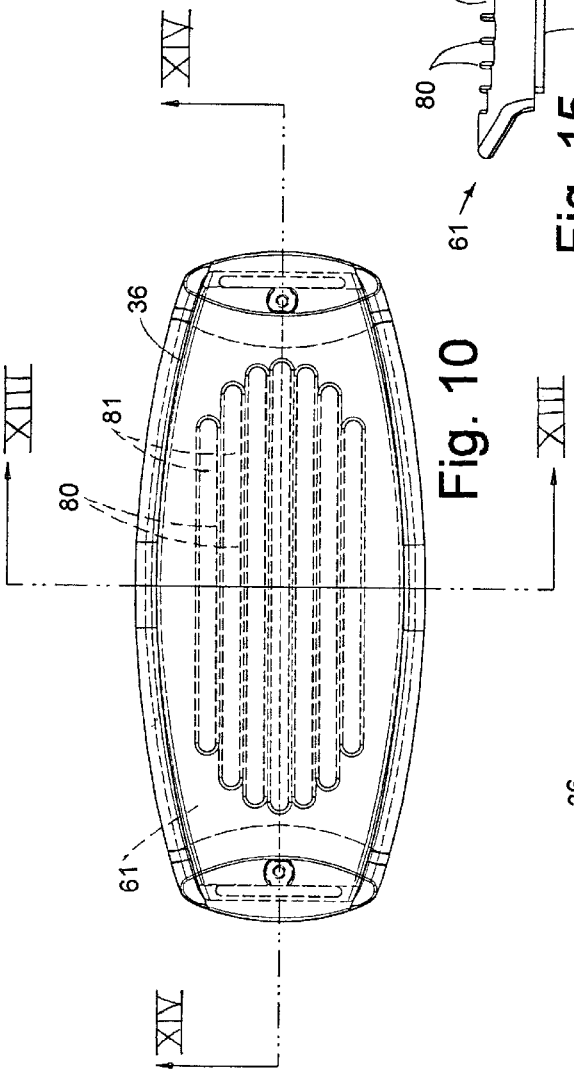
FIGS. 10–12 are top, side, and front views of a top half member of the armrest support shown in FIG. 3 that bridges across and connects to opposing ends of the bottom half member of FIG. 6.
Figure 11:
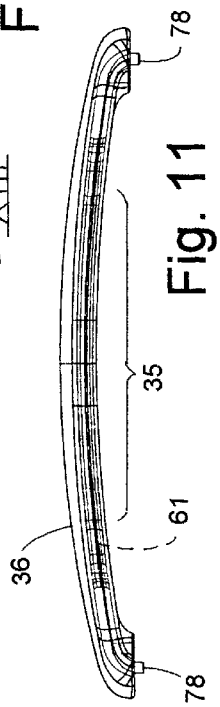
Figure 12:
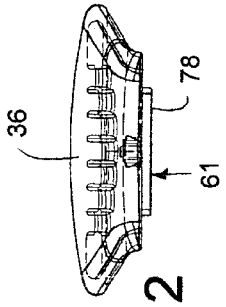

A chair 30 (FIG. 1) includes armrest assemblies 31 embodying the present invention. The armrest assemblies 31 each include an armrest construction 32 (FIG. 10) adjustably mounted atop an under-seat-anchored armrest-supporting structure 41 by a mechanical adjuster mechanism 45. The armrest construction 32 includes a loop-shaped armrest support 33 with a stiff section 34 (FIG. 16) and a flexible section 35, and has an incompressible resilient material 36 (FIGS. 13–14) with a memory, such as a gel, molded onto the flexible section 35. The incompressible resilient material 36 is sufficiently thick and resilient to comfortably support a person's forearm on the support, yet further is sufficiently flowable and stretchable to at least partially move off or through the flexible section 35 when significant pressure is applied to the incompressible resilient material 36, such as when a seated user rests their forearms on, presses on, or grasps the armrests. (See FIG. 19.). In this way, the armrest construction 32 provides exceptionally uniform and comfortable support to a seated person's arm. Further, the gel material 36 is clear or slightly translucent, such that a seated person can see through it. This advantageously allows a seated user to see where the armrest is laterally adjusted to (i.e. "width-wise), and further allows the seated user to see into the ribs 80 as they flex, which can be interesting and desirable to see to assure proper function.

Figure 2:
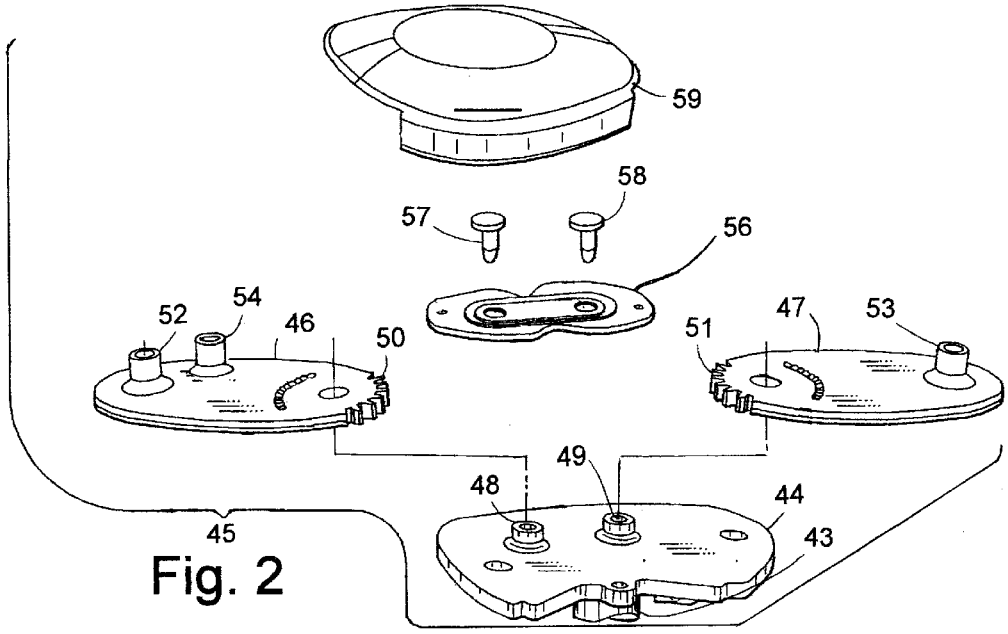
FIG. 2 is an exploded perspective view of a mechanical adjuster mechanism of the armrest which permits lateral adjustment of the armrest construction.

The chair 30 (FIG. 1) includes a seat 38 and a back 39 operably mounted to a base 40 for coordinated movement upon recline of the back 39. The under-seat support 41 is L-shaped and is fixed to a control housing on the base 40. The under-seat support 41 includes a lateral leg 42 that extends from under the seat, and a vertically adjustable up leg 43 that extends above the seat 38. A mounting plate 44 (FIG. 2) is secured to a top of the up leg 43, and the armrest construction 32 is operably mounted to the mounting plate 44 by the mechanical adjuster mechanism 45 (FIG. 2), as discussed below.

The description below of the mechanical adjuster mechanism 45 is sufficient for a person of ordinary skill in this art to understand the present invention. Nonetheless, a more detailed description and disclosure is provided in U.S. Pat. No. 5,971,484 (issued Oct. 26, 1999), and the entire contents of the patent '484 are incorporated herein by reference.

The mounting plate 44 includes a pair of upwardly extending pivot pins 48 and 49, and the mechanical adjuster mechanism 45 includes a pair of gear plates 46 and 47 with holes that rotatably engage the pivot pins 48 and 49. The gear plates 46 and 47 include intermeshing teeth 50 and 51, respectively, such that as one gear plate 46 is rotated, the other gear plate 47 simultaneously also rotates in an opposite direction. The gear plates 46 and 47 include up pivot pins 52 and 53, respectively, that are located at outer ends of the gear plates 46 and 47. An upwardly extending stabilizing finger 54 is located slightly inward of the up pivot pin 52 on gear plate 46. A capture plate 56 is attached atop the gear plates 46 and 47 to the two main pivot pins 48 and 49 by screws 57 and 58, such that the gear plates 46 and 47 are captured on the mounting plate 44 for rotational movement. A cover 59 is attached by screw 59' that extends through hole 59" in plate 44.

Figures 3, 4, 5, 6, 7, 8, 9:
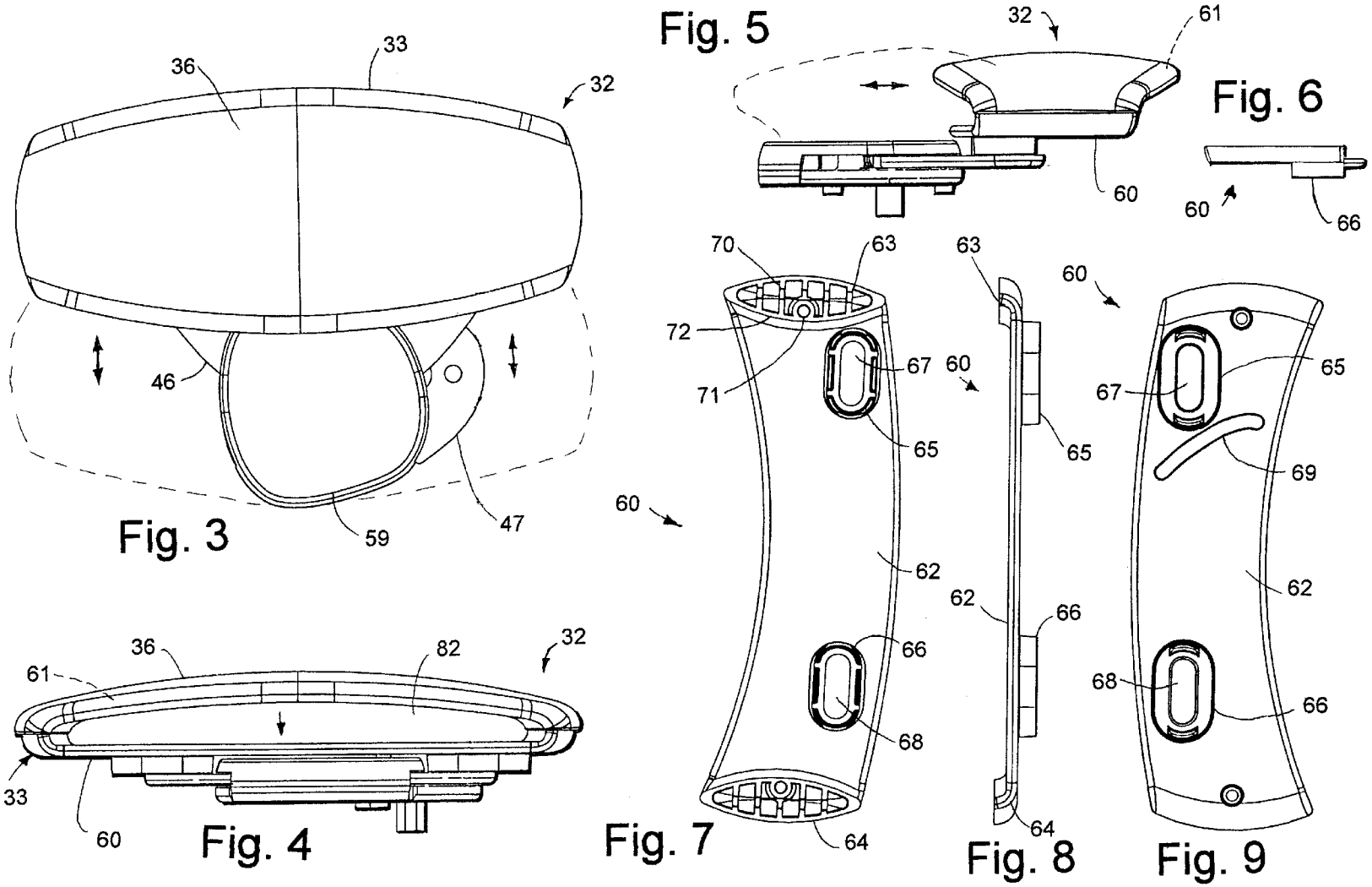
FIGS. 3–5 are top, side, and front views of the armrest construction shown in FIG. 1, including the mechanical adjuster mechanism of FIG. 2, and a gel-covered armrest support.
FIGS. 6–9 are front, top, side, and bottom views of a bottom half support member of the armrest support shown in FIG. 3 that connects to the mechanical adjuster mechanism of FIG. 2.

The armrest support 33 (FIG. 4) has a flattened loop shape, and includes a lower section 60 and an upper section 61. The lower section 60 (FIG. 9) includes an elongated horizontal body 62 having a relatively thin profile (FIG. 8), and includes end sections 63 and 64 at each end of the body 62. The bottom surface of the lower section 60 (FIG. 8) includes longitudinally-elongated rings of marginal material 65 and 66 that form a pair of longitudinally extending guide slots 67 and 68 near an outboard edge of the lower section 60. A curvilinear stabilizer slot 69 (FIG. 9) is formed adjacent the guide slot 67 in the top surface and extends from the inboard edge of the lower section 60 toward an inner end of the guide slot 67 and then arcuately curves toward a middle of the lower section 60 as the stabilizer slot 69 extends to the outboard edge of the lower section 60. The stabilizer slot 69 is configured to slidably engage the stabilizer finger 54 (FIG. 2) so as to cause the armrest support 33 to move laterally in a more controlled and stable manner when the armrest construction 32 is manually adjustingly slid inwardly or (outwardly). Specifically, the stabilizer finger 54 and slot 69 help reduce a tendency of the armrest construction 32 to rotate about a vertical axis and reduce a tendency to quickly slip outwardly. (Notably, as shown in U.S. Pat. No. 5,971,484, the armrest construction may also include structure permitting angular adjustment relative to the seat 38.) The upper surfaces of the end sections 63 and 64 of the lower section 60 (FIG. 7) include reinforcement ribs 70, attachment holes 71 and locator features 72, such as a recess or ledge, that form a rigid mount.

The upper section 61 (FIG. 18) of the armrest support 33 includes an elongated body 74, and end sections 75 and 76. The end sections 75 and 76 are shaped to matingly engage the end sections 63 and 64 of the lower section 60, with the body 74 of the upper section 61 bridging across and forming an arch between the end sections 63 and 64 of the lower section 60. (See FIG. 4.) Screws (not specifically shown) extend upwardly through the attachment holes 71 (FIGS. 7 and 9) in the end sections 63 and 64 of the lower section 60 and threadably into the apertured bosses 77 in the end sections 75 and 76. A protruding ridge 78 engages the locating feature 72 on the lower support 60 to align the upper and lower sections 60 and 61 during assembly and to add stability to the assembly.

The illustrated flexible section 35 (FIG. 16) is formed in a central area of the body 74. The flexible section 35 includes several longitudinally extending ribs 80. The ribs 80 are spaced laterally apart, and form a plurality of apertures 81. The ribs 80 each have a cross section with a vertical dimension that is about four times their width. (See FIG. 19.) However, it is noted that the ribs 80 are supported by and stabilized by the gel material 36 molded around them, such that the ribs 80 flex substantially vertically when pressed. It is noted that the flexible section 35 can be made to be flexible by many different means, including "material" solutions and "dimensional/configuration" solutions, with only a few of these ways being shown in embodiments illustrated herein. For example, the material solutions include using bendable resilient polymers, spring steel, resilient reinforced composite materials, and the like. In the present embodiment, ribs 80 of the flexible section 35 are shaped to flex vertically, as well as the body 74 flexes relative to the ends 75 and 76 and the body 74 flexes relative to the lower section 60.

The incompressible resilient material 36 (FIGS. 13–14) is substantially incompressible, but is stretchable and flexible with a memory. The illustrated gel is a proprietary urethane polymer, such as is described in U.S. Pat. No. 5,670,232 and 5,441,676 (to Bigolin). However, it is contemplated that the term incompressible resilient material as used herein includes other stretchable materials such as rubbers, silicones, and the like, and also that it includes other flowable materials encased in a bladder or balloon configuration.

The illustrated incompressible flexible material 36 (FIG. 19) is molded onto the upper support 61, such that portions of the flexible material wrap around or encapsulate the ribs 80, filling the openings between the ribs 80. As molded, the incompressible flexible material 36 extends above the ribs 80 a distance sufficient to cause the flexible material 36 to evenly re-distribute stress when a seated person presses on the armrest construction 32. This distance D1, as illustrated, is about equal to a width of the space between the ribs 80, such as about ¼ inch. However, it is contemplated that the specific dimensions may vary greatly depending upon the properties of the gel, the dimensions of the ribs and the armrest itself, the expected forces to be exerted by a seated user, and the like. The amount of incompressible flexible material 36 that forms under the ribs 80 can be substantially thinner, such as about a dimension D2 or about ⅛ inch. The purpose of this material is to hold together the material between ribs 80 and further to provide an aesthetic appearance under the upper section 61. Some of the incompressible flexible material 36 (FIG. 19) flows off the ribs 80 and into the openings between the ribs 80 when a person rests their forearm on the armrest construction 32, and some of it flows from between the ribs 80 and below the ribs 80, when a seated user presses on the armrest construction 32. It is noted that this "flowing" action produces a surprisingly and unexpectedly comfortable support where stress is well distributed. Preferably, the dimension D1 is sufficiently thick so that a seated user does not feel the ribs 80 when pressing on the armrest.

In one form, the gel material 36 is sufficiently bonded together such that the gel material 36 does not need to be covered with a fabric. The gel material 36 is sticky, such that it is covered with a clear or translucent material, such as a urethane film or laminate. This provides a novel appearance when the armrest is not covered with a fabric since the gel material 36 is transparent and the ribs 80 can be seen. It is also contemplated that this can provide a utilitarian function, where a seated user can see into the armrest to view an item placed in the space 82 (FIG. 4) under the gel 36. Also, a seated user can see structure through the armrest, such that the seated user can "read" a location of the armrest to determine the adjusted position of the armrest. Thus, the gel forms part of a position indicator for the adjustable component.

It is contemplated that the upper section 61 can be aesthetically covered with upholstery or skinned by ways known in the art. For example, the upper section 61 can be covered by wrapping an upholstery around the armrest, and securing it in place with adhesive, or by covering it with a urethane backedfabric. Also, the molds for forming the gel material can be pre-coated or post-coated with a skin-forming material.

Several additional embodiments are shown in FIGS. 20–24. Components and features of these additional embodiments that are identical or similar to the armrest construction 32 are identified by use of the same number, but with the addition of a letter, such as "A", "B", and "C". This is done to reduce redundant discussion.

In a second embodiment embodying the present invention, an armrest construction 32A (FIG. 20) includes an upper section 61A includes a body 74A and end sections 75A and 76A, with the body 74A including ribs 80A. The incompressible flexible material 36A comprises two sheets 36A' and 36A" of gel material laid onto the ribs 80A. The sheets 36A' and 36A" have different resilient properties. For example, the upper sheet 36A' could be a somewhat stiffer material than the lower sheet 36A", with the upper sheet 36' providing a stable support for a seated user's hand, and with the lower sheet 36A" being much more stretchy and fluid, such that the lower sheet 36A" flows to better distribute stress. It is contemplated that the sheets 36A' and 36A" could be die-cut from a sheet of gel material, or could be molded to their respective shapes.

The armrest construction 32B (FIG. 21) includes a urethane foam 36B' in place of the upper sheet of gel 36A'. The foam 36B' includes a varied thickness optimally suited for comfort and aesthetics. An upholstery 82B is attached around the foam 36B', and tucked under the end sections 75B and 76B, before the upper section 61B is attached to the lower section 60. The body 74B includes holes 83B instead of longitudinally elongated openings between ribs. Notably, the body 74B could be attached directly to the mounting plate 44 in a non-laterally adjustable arrangement, or could include structure permitting it to be operably attached to the gear plates 47 and 48.

Figures 17, 18, 19, 20, 21, 23:
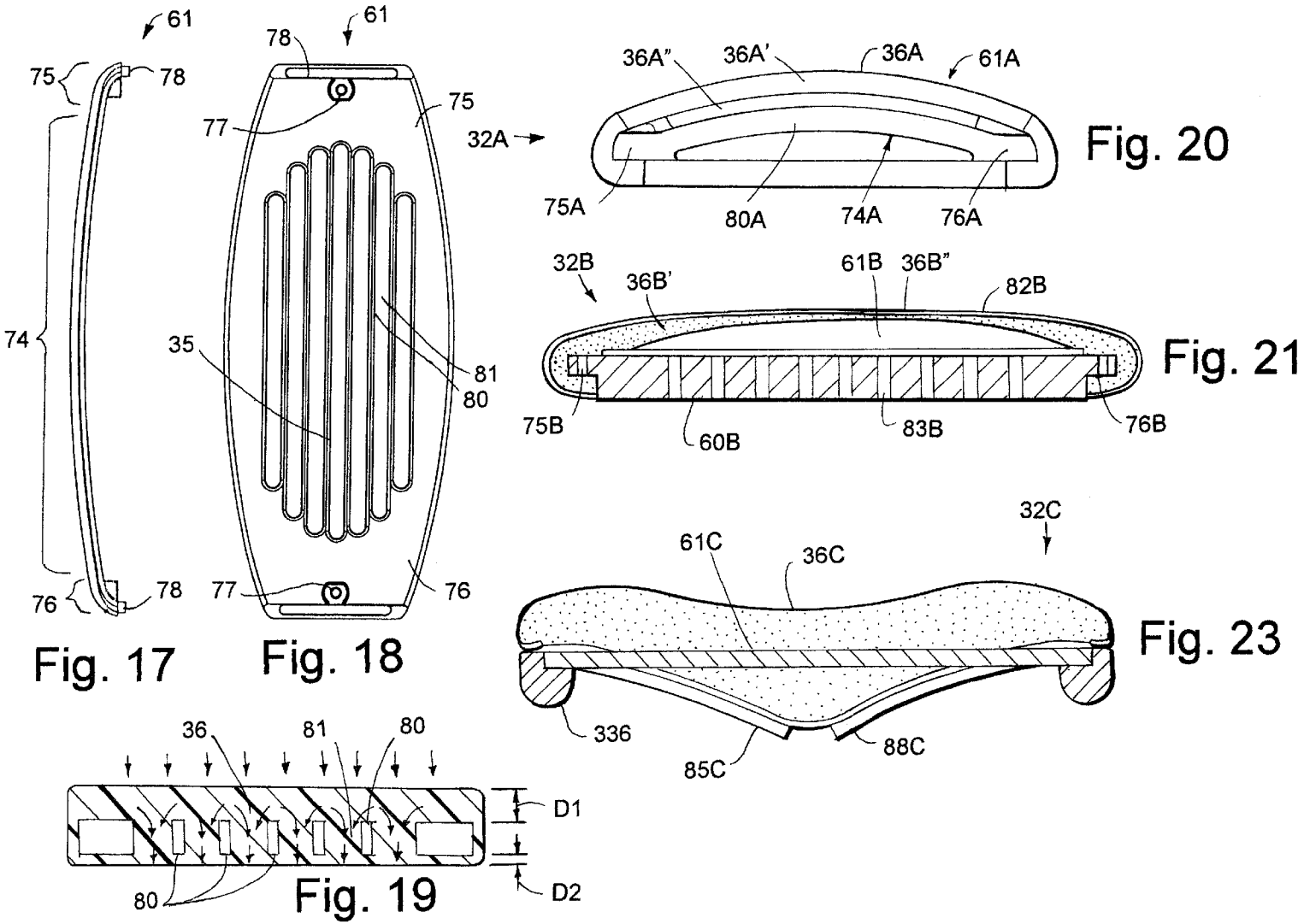
FIG. 19 is an enlarged schematic cross section similar to FIG. 13 but showing movement of the gel material hen stressed.
FIG. 20 is a side view of a first modified armrest similar to FIG. 4.
FIG. 21 is a side view of a second modified armrest similar to FIG. 4.
FIG. 23 is an enlarged transverse cross-section of the armrest shown in FIG. 22.
Figure 22:
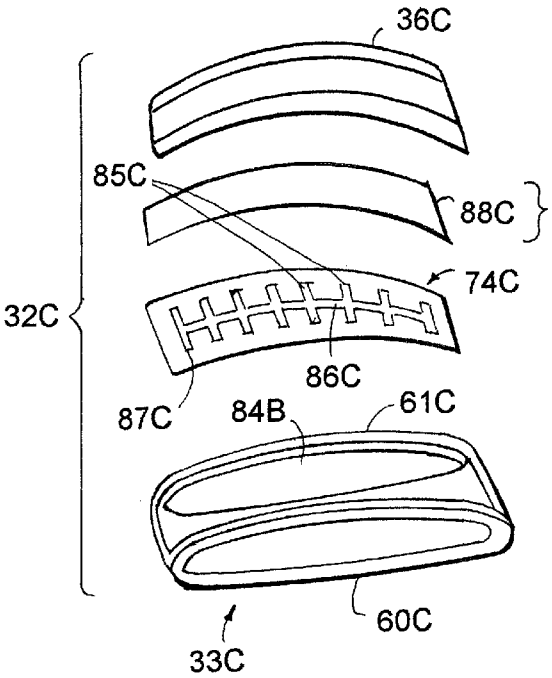
FIG. 22 is an exploded perspective view of a third modified armrest similar to FIG. 4.

FIG. 22 is an exploded perspective view of a third modified armrest construction 32C. Armrest construction 32C is similar to the armrest construction 32 of FIG. 4, but the armrest support 33C includes upper and lower sections 60C and 61C that are formed together as a looped shape. The upper section 61C includes a pair of parallel edge ribs, with a relatively open area 84B between the edge ribs. A separate flexible body 74C is attached to the ribs 80C, and includes inwardly extending leaf-spring-like fingers 85C that form a longitudinal center slot 86C and a plurality of opposing side slits 87C. A stretchable fabric 88C is laid on the body 74C, and a flexible gel or foam material 36C is placed on the stretchable fabric 88C, and enclosed by the fabric 88C. As shown in FIG. 23, the armrest construction 32C provides a very comfortable support for a seated user's forearm, due to the flexure of the flexible material 36C and also due to the flexure of the leaf-spring-like fingers 85C. It is contemplated that the flexible material 36C can be an incompressible flexible material, such as a polyurethane gel or rubber. It is further contemplated that the flexible material could be a liquid or gas, captured in a balloon-like arrangement by the stretchable fabric 88C. Also, it is contemplated that in FIG. 23, a compressible flexible foam could be used.

Figure 24:
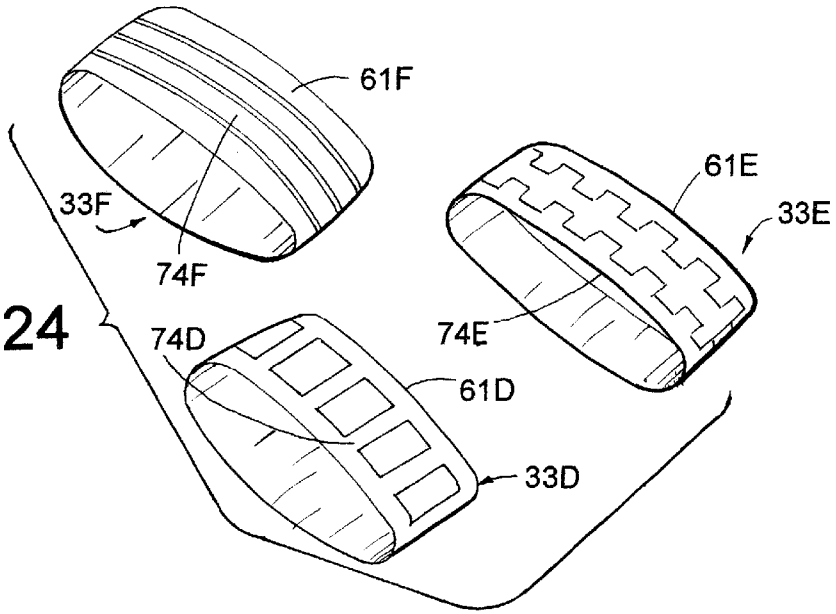
FIG. 24 is a perspective view of a fifth modified armrest similar to FIG. 4.

FIG. 24 illustrates a perspective view of several armrest supports 33D–33F that are not unlike the armrest support 33C. The shape of the upper section 61D, 61E and 61F are varied to provide particular flexural characteristics. For example, upper section 61D provides several enlarged square openings in the body 74D, while the upper section 61E has a zipper-like-shaped opening in the body 74E. The upper section 61F has a plurality of longitudinally extending slits forming parallel leaf-spring-like strips in the body 74F. Each of these arrangements provides a flexible section for supporting a gel or other incompressible resilient material 36.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An armrest comprising:

an armrest-supporting structure adapted for connection to a chair base;

an armrest member supported by the armrest-supporting structure and including at least one stiff section and a flexible section connected to the stiff section, the stiff section being located in a perimeter area of the armrest member and including a mount secured to the armrest-supporting structure; and a section of incompressible resilient material coupled to and supported by the flexible section, the incompressible resilient material being molded onto the flexible section and covering the at least one stiff section; and wherein the flexible section includes ribs spaced apart to define apertures therebetween.

2. The armrest defined in claim 1, wherein the at least one stiff section includes a pair of opposing end sections, and wherein the ribs are supported on each end by the opposing end sections.

3. The armrest defined in claim 2, wherein the ribs include at least three ribs.

4. An armrest comprising:

an armrest-supporting structure adapted for connection to a chair base;

an armrest member supported by the armrest-supporting structure and including at least one stiff section and a flexible section connected to the stiff section, the stiff section being located in a perimeter area of the armrest member and including a mount secured to the armrest-supporting structure; and a section of incompressible resilient material coupled to and supported by the flexible section, the flexible section including ribs spaced apart to define apertures therebetween; and wherein the section of incompressible resilient material characteristically stretches and flows when stressed, but includes memory such that the resilient material reforms to a predetermined shape when released, such that the resilient material stretches and flows into the apertures when pressed downward.

5. The armrest defined in claim 4, wherein the incompressible resilient material is clear, such that movement of the flexible section can be seen.

6. An armrest comprising:

an armrest-supporting structure adapted for connection to a chair base, an armrest member supported by the armrest-supporting structure and including at least one stiff section and a flexible section connected to the stiff section, the stiff section being located in a perimeter area of the armrest member and including a mount secured to the armrest-supporting structure; and a section of incompressible resilient material coupled to and supported by the flexible section, the flexible section including ribs each having a fixed end supported by the at least one stiff section and a flexible end that is unsupported and moveable.

7. The armrest defined in claim 6, wherein the section of incompressible resilient material characteristically stretches and flows when stressed, but includes memory such that the resilient material reforms to a predetermined shape when released, such that the resilient material stretches and flows into a new shape when pressed downward.

8. The armrest defined in claim 6, wherein the section of incompressible resilient material includes a gel material.

9. The armrest defined in claim 8, wherein the gel material includes a urethane material.

10. An apparatus comprising:

a support component having a stiff section with an attachment mount thereon and a flexible section extending from the stiff section, the flexible section including strips of material constructed to flex relative to the stiff section; and incompressible resilient material coupled to the flexible section for cooperative distribution of stress, and wherein a portion of the incompressible resilient material fits within the flexible section.

11. The apparatus defined in claim 10, wherein the incompressible resilient material is clear.

12. The apparatus defined in claim 10, wherein the strips include a free end constructed to flex relative to the stiff section.

13. The apparatus defined in claim 10, wherein the incompressible resilient material covers an upper surface of the strips.

14. The apparatus defined in claim 10, wherein the incompressible resilient material is molded onto the support.

15. An apparatus comprising:

an article;

a component attached to the article, the component being shaped and configured to support a human body part; and a transparent material covering at least one side of the component and preventing physical access to the component but allowing visual access to the component wherein the transparent material comprises a gel.

16. The apparatus defined in claim 15, wherein the article comprises a chair.

17. The apparatus defined in claim 15, wherein the transparent material forms a flexible window.

18. The apparatus defined in claim 15, wherein the component is adjustable, and the visual access provides feedback on an adjusted position of the component.

19. The apparatus defined in claim 18, wherein the article comprises a chair, and the component includes a laterally adjustable armrest connected to the chair with a mechanical adjuster mechanism.

20. The apparatus defined in claim 15, wherein the component is moveable, and the visual access provides feedback to the user during movement.

21. The apparatus defined in claim 20, wherein the component includes a flexible section.

22. The apparatus defined in claim 21, wherein the flexible section includes parallel flexible leaf-spring fingers.

* * * * *